US007496001B2

(12) United States Patent
Theriault et al.

(10) Patent No.: US 7,496,001 B2
(45) Date of Patent: Feb. 24, 2009

(54) LIGHT AND NOISE MAKER FOR DIVING USE

(76) Inventors: Trevor Theriault, 741 William Street, London, ON (CA) N6Y 2R5; David E. Livingstone, 741 William Street, London, ON (CA) N6Y 2R5

( * ) Notice: Subject to any disclaimer, the term of this patent is extended or adjusted under 35 U.S.C. 154(b) by 114 days.

(21) Appl. No.: 11/535,268

(22) Filed: Sep. 26, 2006

(65) Prior Publication Data

US 2007/0070620 A1 Mar. 29, 2007

Related U.S. Application Data

(63) Continuation-in-part of application No. 11/097,343, filed on Apr. 4, 2005, now abandoned.

(60) Provisional application No. 60/720,460, filed on Sep. 27, 2005.

(51) Int. Cl.
*F21L 4/04* (2006.01)

(52) U.S. Cl. ..... 367/141

(58) Field of Classification Search ..... 367/141; 362/86, 253

See application file for complete search history.

(56) References Cited

U.S. PATENT DOCUMENTS

| | | | |
|---|---|---|---|
| 2,908,901 | A | 10/1959 | Lewis |
| 3,351,901 | A | 11/1967 | Padberg |
| 4,114,187 | A | 9/1978 | Uke |
| 4,531,178 | A | 7/1985 | Uke |
| 4,588,387 | A | 5/1986 | Swenson |
| 4,870,550 | A | 9/1989 | Uke |
| 4,985,812 | A | 1/1991 | Uke |
| 5,187,691 | A | 2/1993 | Oeheme |
| 5,400,736 | A | 3/1995 | Gold |
| 5,450,810 | A | 9/1995 | Knight |
| 5,652,734 | A | 7/1997 | Fish |
| 6,024,054 | A | 2/2000 | Matt |
| 6,160,760 | A | 12/2000 | Rayner |
| 6,431,734 | B1 | 8/2002 | Curry |
| 6,547,414 | B2 | 4/2003 | Steger |
| 6,582,097 | B2 | 6/2003 | Chang |
| 6,690,619 | B2 | 2/2004 | Brausam |
| 6,776,503 | B1 | 8/2004 | Chang |
| 2004/0136186 | A1 | 7/2004 | Hsu |

OTHER PUBLICATIONS

Scuba Shaker from Omersub Submarine Technology (May 6, 2003) http://www.omersub.com/omerscuba/catalog/accessories/index.htm; one page.*

* cited by examiner

*Primary Examiner*—Dan Pihulic
(74) *Attorney, Agent, or Firm*—Standley Law Group LLP

(57) ABSTRACT

A dive accessory has an outer shell that encompasses a light maker and a noise maker. The light maker is waterproofed and has a light source electrically connected to an electrical power source for powering the light source. A light switch selectively opens and closes the electrical connection to switch the light source on and off. The noise maker has a hollow chamber containing a solid object that is movable within the hollow chamber to produce a noise when the solid object strikes a wall of the hollow chamber. The solid object may be restrained from moving to prevent the solid object from making noise. Combining a light maker and a noise maker provides a more effective dive accessory.

23 Claims, 6 Drawing Sheets

LIGHT AND NOISE MAKER FOR DIVING USE

CROSS-REFERENCE TO RELATED APPLICATIONS

This application is a non-provisional of Ser. No. 60/720,460, now expired, filed on 27 Sep. 2005, which is incorporated by reference as if fully recited herein. This application is a continuation in part of, and claims priority to, Ser. No. 11/097,343, now abandoned, filed 4 Apr. 2005.

FIELD OF THE INVENTION

The present invention relates to an integrated accessory for underwater diving. More particularly, the present invention is related to a combination dive light and noise maker for signaling other divers.

BACKGROUND OF THE INVENTION

Diving flashlights are known in the art, for example U.S. Pat. Nos. 6,547,414, 4,114,187, 4,531,178 and 4,870,550. Underwater audible signaling devices based on the principle of hard objects rattling in a chamber are also known in the art, for example, U.S. Pat. Nos. 5,187,691, 5,652,734 and 5,450,810 and the Scuba shaker product sold by Omersub Submarine Technology. U.S. Pat. No. 6,690,619 teaches strapping a light stick to an audible signaling device. It is also known to combine a flashlight and an electronic audible alarm into a night stick, for example U.S. Pat. No. 2,908,901. All of these devices fulfill certain needs, but they all have limited versatility for underwater divers. There remains a need in the art for a dive accessory that combines the functions of a variety of tools into a single integrated unit that is convenient and easy to use, versatile and robust.

SUMMARY OF THE INVENTION

In accordance with an exemplary embodiment, there is provided a dive accessory comprising an outer shell encompassing a light maker and a noise maker, the light maker being waterproofed and comprising a light source electrically connected to an electrical power source for powering the light source, and a light switch for selectively opening and closing the electrical connection between the light source and the electrical power source to switch the light source between an on state and an off state, the noise maker comprising a hollow chamber having a solid object therein, the solid object movable within the hollow chamber to produce a noise when the solid object strikes a wall of the hollow chamber, the noise maker further comprising means for restraining movement of the solid object to prevent the solid object from making noise.

There is further provided a dive accessory comprising an outer shell encompassing a light maker and a noise maker, the light maker being waterproofed and comprising a light source electrically connected to an electrical power source for powering the light source, and a light switch for selectively opening and closing the electrical connection between the light source and the electrical power source to switch the light source between an on state and an off state, the noise maker comprising a hollow chamber having a solid object therein, the solid object movable within the hollow chamber to produce a noise when the solid object strikes a wall of the hollow chamber, the noise maker further comprising means for selectively restraining movement of the solid object to prevent the solid object from making noise and further comprising means for selectively permitting movement of the solid object to permit the solid object to make noise.

There is yet further provided a dive accessory comprising an outer shell encompassing a light maker and a noise maker, the light maker being waterproofed and comprising a light source electrically connected to an electrical power source for powering the light source, and a light switch for selectively opening and closing the electrical connection between the light source and the electrical power source to switch the light source between an on state and an off state, the noise maker comprising a hollow chamber having a solid object therein, the solid object movable within the hollow chamber to produce a noise when the solid object strikes a wall of the hollow chamber, the noise maker further comprising means for selectively restraining movement of the solid object to prevent the solid object from making noise while automatically permitting movement of the solid object within the hollow chamber to make noise upon shaking of the dive accessory.

The outer shell encompasses both the light maker and the noise maker thereby providing a unitized, structurally integrated device that is durable, portable and aesthetically attractive. Preferably, the outer shell is waterproofed to prevent water from damaging the parts, particularly the electrical parts of the light maker. The outer shell may entirely enclose both the light maker and the noise maker.

The outer shell may comprise any suitable material for the construction of dive accessories, for example, metal, plastic, elastomers, rubber, etc. Materials that are lightweight, strong, corrosion resistant, or a combination thereof are preferred, for example, aircraft grade aluminum and shock resistant plastic. Transparent shock resistant plastic is particularly preferred in front of the light maker in order to permit illumination in front of the dive accessory. Rubber or elastomers are preferred for use in making watertight seals (e.g. membrane seals, O-rings, etc.) around switches and joints.

The outer shell has an internal cavity that may be subdivided into individual compartments. One compartment may be the hollow chamber of the noise maker. Another compartment may contain the electrical power source. Yet another compartment may hold the light source and any mirrors for focusing and/or directing a light beam. The compartment for holding the light source may swivel for directing the light beam in various directions, and/or may be provided with a facility for creating focussed, normal or wide-angle beams. The compartment for holding the light source may also be provided with rubberized or non-rubberized molded finger grips to assist divers wearing gloves. Still yet other compartments may be included for holding other components of the accessory or for storing various other items. Compartments may be openable to permit access to their interiors.

The light maker comprises a light source, an electrical power source for powering the light source and a light switch for switching the light source on and off. The light maker may also comprise any other standard dive light components. The light source may be any suitable light-emitting element, for example, tungsten filament bulbs, halogen bulbs, light emitting diodes (LED), etc. LEDs are particularly preferred for their durability. The light maker may comprise more than one light source powered by the same power source or different power sources. The power source is preferably a battery or batteries, although other power sources such as shipboard and portable generators may be used. There may be one or more light switches to control intensity of illumination. The switch or switches may be of any suitable type typically used on flashlights, particularly underwater flashlights. In addition to switching the light source on and off, the light switch or switches may dim or intensify the illumination. Components of the light maker are located in waterproofed compartments to prevent water damage. A shock isolator may be placed between the noise maker and light maker to reduce the possibility of damage to the light maker.

The noise maker is based on the principle of a solid object striking a wall within a hollow chamber. Such noise makers are referred to as clackers. The noise maker in the present invention comprises a hollow chamber having a solid object therein. The solid object is movable within the hollow chamber to produce a noise when the solid object strikes a wall of the hollow chamber. When a diver shakes the dive accessory, the noise made by the solid object striking the wall of the hollow chamber will carry though the water alerting other divers. Since water is a denser medium than air, sound travels better in water. Such a noise maker is particularly effective for communicating with other divers, particularly in low visibility conditions. Furthermore, since it is unnecessary for a diver to bang an object (e.g. a dive knife) against his tanks, and it is unnecessary to tap other divers on the shoulder, a measure of safety is also afforded.

The hollow chamber may be of any suitable size and shape. Preferably, the hollow chamber is substantially cylindrical. The hollow chamber, while encompassed by the outer shell, can be open to the water provided the chamber is waterproofed to prevent water from entering other compartments of the dive accessory and provided that the solid objects cannot escape from the hollow chamber. Preferably, the hollow chamber is enclosed by the outer shell so that water may not enter into the hollow chamber.

The hollow chamber may be formed by the walls of the outer shell. Alternatively, the hollow chamber may be formed in a noise-making module having its own housing enclosing the hollow chamber. The module is insertable in the outer shell and sized to fit in the outer shell, preferably encompassed entirely within the outer shell. A modular noise maker permits retrofitting of existing flashlights. The existing flashlight's battery pack may be reduced in size to provide space for the module. Further, a kit may be created by providing a flashlight, or components of a flashlight including the outer shell, together with a noise-making module and instructions for assembling the flashlight and noise-making module into a dive accessory.

The solid object may be any suitable size and shape provided the solid object is movable within the hollow chamber. Preferably the solid object is spherical or cylindrical. In one example, the solid object may be cylindrical having a diameter slightly less than the diameter of the hollow chamber and a length sufficiently less than the length of the hollow chamber so that the cylindrical object can generate sufficient motion to make sufficient noise when it strikes an end wall of the hollow chamber. In another example, the solid object is spherical and has a diameter slightly less than the diameter of the hollow chamber so that the spherical object can roll within the hollow chamber. There may be any number of solid objects within the hollow chamber. When a cylindrical solid object is used, there is preferably one solid object. When a spherical solid object is used, there is preferably more than one solid object. In magnetic embodiments of the dive accessory, there is preferably one solid object.

The solid object may comprise any suitably solid and dense material. The solid object preferably comprises a material that does not corrode. For magnetic embodiments of the dive accessory, the solid object comprises a ferromagnetic material and/or a magnetic material. More preferably, the solid object comprises a metal (for example, iron, nickel, cobalt and alloys of metals (e.g. steel, stainless steel and ferromagnetic alloys)), a ceramic, a dense plastic or plastic composite, or a combination thereof. Solid objects comprising non-ferromagnetic materials may be made ferromagnetic by including ferromagnetic materials therein. Stainless steel is a particularly preferred material for the solid object in non-magnetic embodiments of the dive accessory. Steel, iron or corrosion resistant ferromagnetic alloys are preferred materials for the solid object in magnetic embodiments of the dive accessory.

The noise maker comprises means for restraining movement of the solid object to prevent the solid object from making noise. The means for restraining movement of the solid object may automatically permit movement of the solid objects when the dive accessory is shaken, and/or the dive accessory may further comprise means for selectively permitting movement of the solid object to permit the solid object to make noise. The means for restraining movement may be selective, that is, to selectively restrain movement, a positive action is required by a diver. Where movement of the solid object is selectively permitted, a separate positive action is required by the diver before shaking of the dive accessory can produce a noise. Where movement of the solid object is automatically permitted, shaking of the dive accessory will permit a noise without the diver having to perform a separate positive action.

Such features dramatically increase the desirability of the dive accessory as the ability to turn off the noise generating capacity greatly enhances the versatility, convenience and safety of the noise maker. The ability to selectively and/or automatically control the noise maker further enhances the versatility, convenience and safety of the noise maker.

In a first aspect, the noise maker comprises means for selectively restraining movement of the solid object and means for selectively permitting movement of the solid object. Thus, the noise maker must be "turned on" before shaking the dive accessory will produce a noise. The means for selectively restraining movement of the solid object and the means for selectively permitting movement of the solid object may be the same or different means. Thus, one means may selectively control both on and off, or, on may be selectively controlled by one means and off selectively controlled by another means. Such means may be embodied in, for example, bayonet linkages between parts of the outer shell, switches such as slide switches, depression switches, toggle switches, rocker switches, rotary switches and the like, or any other arrangement of parts that result in restraining and/or permitting movement of the solid object.

Whether one means controls both on and off, or one means controls on and another means controls off, there may be a common element involved in controlling the noise maker, for example an electromagnet or an element that decreases or increases the length or height of the hollow chamber (e.g. a movable wall within the hollow chamber). Where a movable wall is used, selective activation of the means for restraining movement would result in a decrease of the length or height of the hollow chamber while selective activation of the means for permitting movement would result in an increase in the length or height of the hollow chamber.

In the first aspect, the hollow chamber may comprise a movable end, the movable end movable between a retracted position for restraining movement of the solid object and an extended position for permitting movement of the solid object. In the first aspect, the hollow chamber may comprise a movable side wall, the movable side wall movable between a depressed position for restraining movement of the solid object and a raised position for permitting movement of the solid object. The dive accessory may further comprise biasing means (e.g. a spring) for biasing the movable end or side wall toward the extended or raised position.

The means for selectively permitting movement of the solid object may comprise an armature having means for engaging the movable end to hold the movable end in the retracted position and means for disengaging the armature from the movable end to permit the movable end to move to the extended position to permit movement of the solid object. The means for selectively permitting movement of the solid object may further comprise means for biasing the armature into a position for engagement with the movable end. The armature may have a first portion, a second portion and a pivot point between the first portion and the second portion. The means for engaging the movable end may be on the first portion, the means for disengaging the armature from the movable end may be on the second portion, and the means for biasing the armature may comprise a biasing element (e.g. a torsion spring) at the pivot point. Activation of the means for disengaging the armature may cause the armature to pivot at the pivot point thereby disengaging the armature from the movable end. Deactivation of the means for disengaging the armature permits the biasing element to bias the armature into the position for engagement with the movable end.

The means for selectively restraining movement of the solid object may comprise an element (e.g. a piston) connected to the movable end, whereby depression of the element causes the movable end to move to the retracted position to restrain movement of the solid object. The movable end in the retracted position may then engage the means for selectively permitting movement in order to prevent movement of the movable end to the extended position until and unless the means for selectively permitting movement of the solid object is activated.

Such means for restraining and permitting movement as described above are also applicable to the movable side wall.

The means for selectively restraining movement and selectively permitting movement may comprise the same means. For example, a rotary switch comprising a screw element may be used to move the movable wall. The screw element may be set in the outer shell such that the tip of the screw element engages the movable wall. Rotation of the screw element in one direction would cause the wall to move toward the solid object thereby reducing the size of the hollow chamber to restrain the solid object. Rotation of the screw element in the other direction would cause the wall to move away from the solid object thereby increasing the size of the hollow chamber to permit movement of the solid object. Stops may be included to prevent over-tightening of the screw element. Movement of a side wall rather than an end wall provides maximal translation of the solid object in the hollow chamber since the means for restraining the solid object works from a side rather than an end of the hollow chamber.

In the first aspect, the hollow chamber may have an electromagnet located at a hold position and the solid object may comprise a ferromagnetic material. The electromagnet should be of sufficient field strength to hold the solid object under all conditions. Power for the electromagnet may derive from the same power source as the light maker, or a separate power source may be included in the dive accessory. A switch would permit the diver to selectively turn the electromagnet on or off in order to selectively restrain or selectively permit movement of the solid object.

In a second aspect, the noise maker comprises means for selectively restraining movement of the solid object while automatically permitting movement of the solid object upon shaking of the dive accessory. Thus, the noise maker need not be "turned on" before the dive accessory is shaken to produce a noise. This aspect advantageously permits control of the noise making capacity with less or no manipulation of a switch or the like. The means for restraining movement of the solid object while automatically permitting movement of the solid object may comprise a weak biasing means (e.g. a spring) or a magnet.

In the case of a magnet, the solid object comprises a ferromagnetic material. The magnet should have sufficient field strength to hold the solid object proximal a hold position in the hollow chamber under normal conditions but insufficient field strength to hold the solid object when the dive accessory is being shaken to make noise. The hold position is preferably located at one end of the hollow chamber. The magnet may be a permanent magnet or an electromagnet. A permanent magnet is preferred. The magnet is preferably coated with a corrosion resistant material, for example nickel. Magnetic shielding may be employed to insulate the magnet from the surroundings, other than from the solid object, in order to protect electronic equipment and compasses from stray magnetic fields.

Under normal conditions, the dive accessory is being held by the diver or is attached to the diver in some other way (e.g. a tether line). The diver may be moving and normal movement should not dislodge the solid object from the hold position. When the dive accessory is shaken relatively vigorously, the solid object should dislodge from the hold position to move within the hollow chamber. When the dive accessory is held in a relatively still position such that the solid object returns to the hold position, the magnet will once again hold the solid object. It will be understood that under some circumstances, the solid object may move on its own to the hold position under less vigorous conditions where it will be held again by the magnet. Since the noise maker does not require positive action by the diver to permit movement of the solid object before shaking the dive accessory, the noise maker automatically permits movement of the solid object.

A permanent magnet is particularly useful when the hollow chamber is formed in a noise-making module having its own housing. The magnet may be attached to the housing at a hold position, preferably at one end of the housing. The magnet is preferably immovably integrated into the housing so that it is not removable from the housing under normal circumstances. The housing is preferably cylindrical and the magnet is preferably located on one end of the cylindrical housing. The magnet may be located inside or outside the hollow chamber, or both.

In a third aspect, a variable strength electromagnet may be used to provide a dive accessory in which the means for permitting movement of the solid object may be either selective or automatic at the discretion of the diver. By setting the magnetic field strength high, the dive accessory operates in a manner as described above for the electromagnet in the first aspect in which the means for permitting movement of the solid object is selective requiring the diver to turn off the electromagnet before noise can be generated. By setting the magnetic field strength sufficiently lower, the dive accessory operates in a manner as described for the second aspect in which the means for permitting movement of the solid object is automatic. Field strength may be varied by varying the electrical current to the electromagnet, or by having two or more electromagnets that may be independently activated.

Where magnets are used, the magnetic field strength of the magnet or magnets should be set appropriately for the particular manner in which the magnet is used. In addition, magnet size, magnet quality, mass of the solid object, size of the solid object, mass of the solid object, shape of the solid object, magnetic attractiveness of the solid object, and spacing between the magnet and solid object will influence the required magnetic field strength. It is well within the province of one skilled in the art to empirically determine an appropriate magnet for the particular circumstance.

In an embodiment where a magnet acts to restrain movement of the solid object when the dive accessory is not being shaken while automatically permitting movement of the solid object upon shaking the dive accessory, formula (I) below may be used as a guide for determining the required magnetic strength of the magnet.

$$G = \frac{0.785W((S+D)/T)^3}{VA} \quad \text{(I)}$$

wherein:

G is magnetic strength in gauss at the surface of the magnet;

W is the weight in pounds of the solid object;

S is the spacing in inches between the magnet's surface and the solid object;

D is the distance in inches to the center of mass of the solid object from end of the magnet;

T is one-half the thickness in inches of the magnet;

V is the volume of the solid object plus the volume of the magnet in cubic inches; and, A is the area in square inches of the end of the magnet.

For a magnet of a given field strength and a solid object of a given weight, formula (I) may be re-arranged to give formula (II) for determining the spacing (S) that would be required between the magnet's surface and the solid object.

$$S=T((GVA)/(0.785W))^{1/3}-D \quad \text{(II)}$$

The dive accessory of the present invention may further include one or more dive utility items, for example, attachment rings, tether lines (e.g. retractable or non-retractable), measuring devices (e.g. rulers, depth gauges, lobster gauges, clocks, stop watches, etc.), whistles, audible electronic alarms, dive computers, GPS, locator chips, utility knives, line cutters, laser pointers, etc. Dive utility items may be attached to or integrated with the dive accessory. Dive utilities, for example rulers and gauges, may be luminescent or phosphorescent for greater visibility.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which identical parts are identified by identical part reference numbers and wherein.

DESCRIPTION OF PREFERRED EMBODIMENTS

Figure 1A:
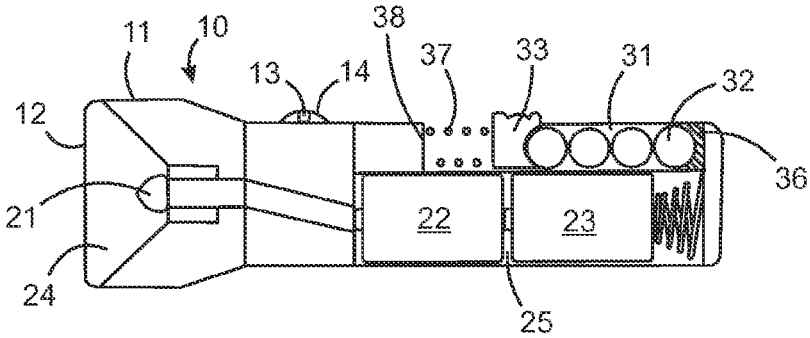
FIG. 1A is a schematic cross-sectional side view of a first embodiment of a dive accessory, a clacker being in an "off"-position.
Figure 1B:
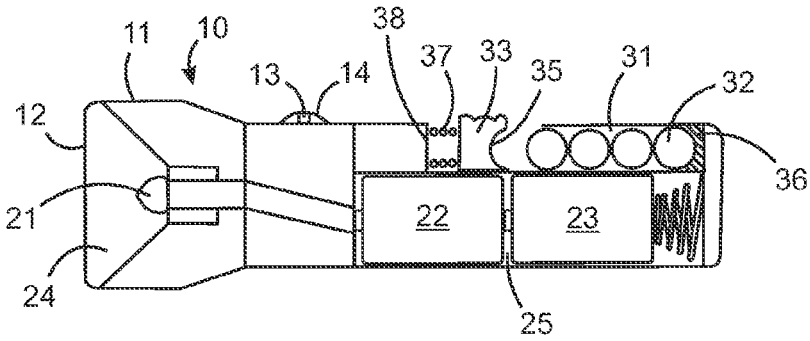
FIG. 1B is a schematic cross-sectional side view of the FIG. 1A dive accessory with the clacker in an "on"-position.

Referring to FIGS. 1A and 1B, a first embodiment of a dive accessory of the present invention is shown with a clacker in an off-position (FIG. 1A) and in an on-position (FIG. 1B). The dive accessory 10 comprises a shock resistant plastic outer shell 11 in which transparent front lens 12 permits illumination in front of the dive accessory from a light maker comprising LED 21 electrically connected to two D-cell batteries 22,23. LED 21 and batteries 22,23 are located in waterproof compartments 24,25, respectively. LED 21 is switched on and off using a depression switch 13 located under elastomeric membrane seal 14. The mechanical and electrical arrangement for the light maker is typical of the art, for example as described in U.S. Pat. Nos. 6,547,414, 4,114,187, 4,531,178 or 4,870,550, the disclosures of which are herein incorporated by reference.

The clacker comprises a hollow chamber 31 containing four spherical solid stainless steel ball bearings 32 (only one labeled) and a slide switch 33 for selectively restraining and selectively permitting movement of the bearings 32 in the hollow chamber 31. The slide switch has a curved surface 35 that matches the curvature of the bearings 32. The slide switch 33 is slidable within the hollow chamber between an object restraining position (i.e. the off-position) as shown in FIG. 1A and an object liberating position (i.e. the on-position) as shown in FIG. 1B. When the slide switch 33 is in the on-position, the bearings 32 are permitted to move in the hollow chamber 31 and a diver may shake the dive accessory so that the bearing 32 strike each other and end wall 36 of the hollow chamber to produce a noise. When the slide switch 33 is in the off-position, the bearings 32 are restrained from moving so they cannot make noise by striking each other and the end wall. The slide switch 33 may be conveniently handled by a finger or thumb.

The clacker may further comprise means for automatically returning the switch to the off-position. For example, in dive accessory 10, a spring 37 (e.g. a compression spring) between the switch 33 and end wall 38 of the hollow chamber 31 biases the switch towards the bearings 32. Pressure from a diver's finger is able to slide the switch 33 to the object liberating position against the bias of spring 37. Release of the pressure will cause the spring 37 to automatically slide the switch 33 to the object restraining position. Although the diver is not required to actively close the switch, he may still do so if desired. A locking mechanism (not shown) may be used to hold the switch 33 in the on-position.

Figure 1C:
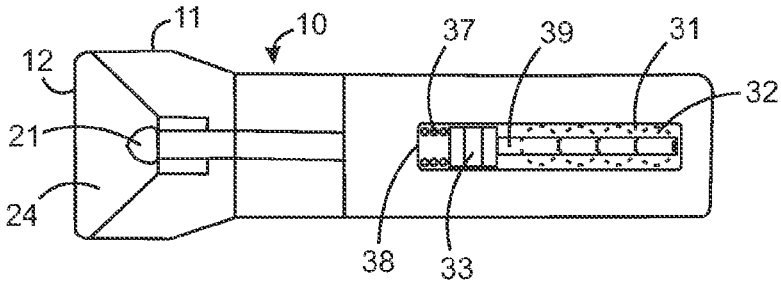
FIG. 1C is a schematic top view of the FIG. 1B device.

Referring to FIG. 1C, a top schematic view of the dive accessory of FIG. 1B is shown. The hollow chamber 31 is provided with a slot 39 of sufficient width to permit the slide switch 33 to slide within the slot. The slot 39 is sufficiently narrow so that the bearings 32 do not escape from the hollow chamber 31. Since the slot 31 opens the hollow chamber 31 to water, the inside of the hollow chamber is waterproofed to prevent water from entering into the other compartments of the dive accessory. Alternatively or additionally, a membrane seal may be used over the slot and switch to keep water out of the hollow chamber.

Figure 1D:
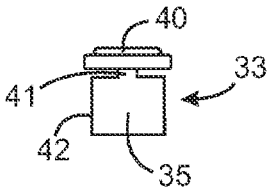
FIG. 1D is an end view of a switch depicted in FIGS. 1A-1C.

As shown in FIG. 1D, the switch 33 comprises an upper body portion 40 attached to a lower body portion 42 by a neck 41. The neck 41 is narrow enough to be able to slide through the slot of the hollow chamber. The curved surface 35 on the lower body portion 42 is sufficiently large to make considerable contact with the bearings. When the neck 41 is engaged in the slot, the upper and lower body portions engage the upper and lower surfaces of the hollow chamber to hold the switch on the hollow chamber. The upper body portion 40 is provided with ridges (best seen in FIGS. 1A and 1B) to provide better grip on the switch.

Figure 2A:
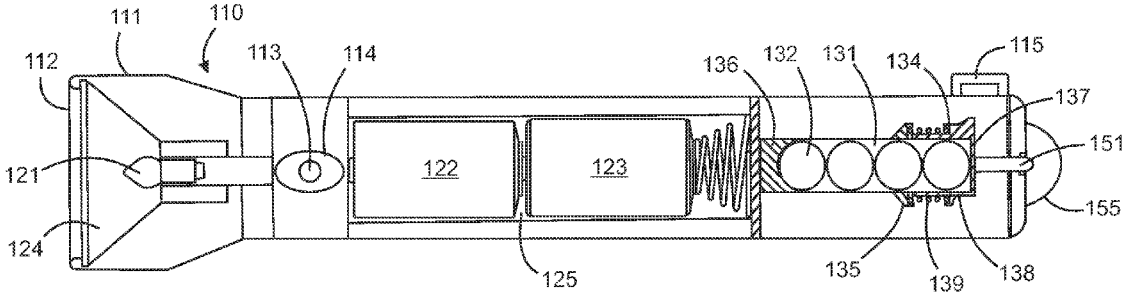
FIG. 2A is a schematic cross-sectional top view of a second embodiment of a dive accessory with a clacker in an "off"-position.
Figure 2B:
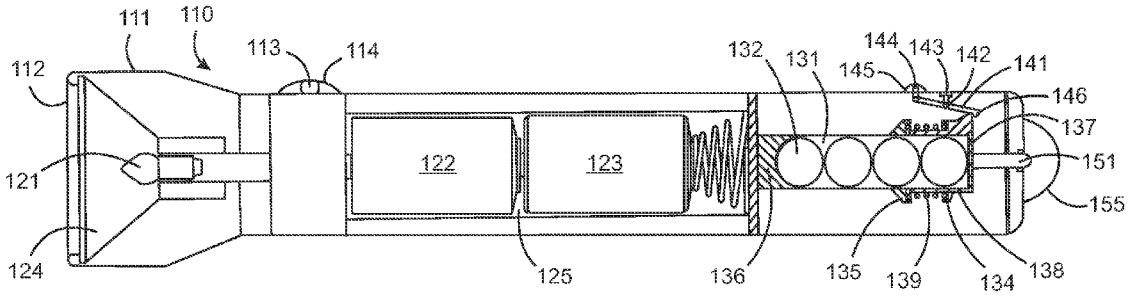
FIG. 2B is a schematic cross-sectional side view of the FIG. 2A dive accessory.
Figure 3A:
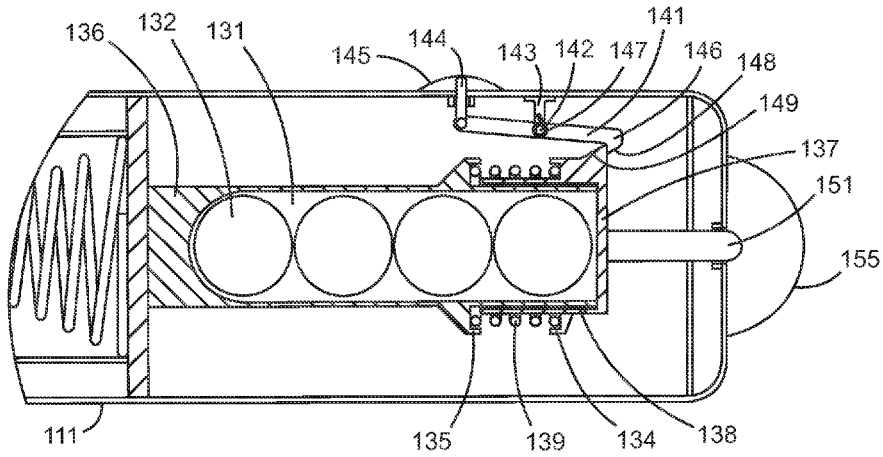
FIG. 3A is an enlarged view of the clacker depicted in FIG. 2A.
Figure 3B:
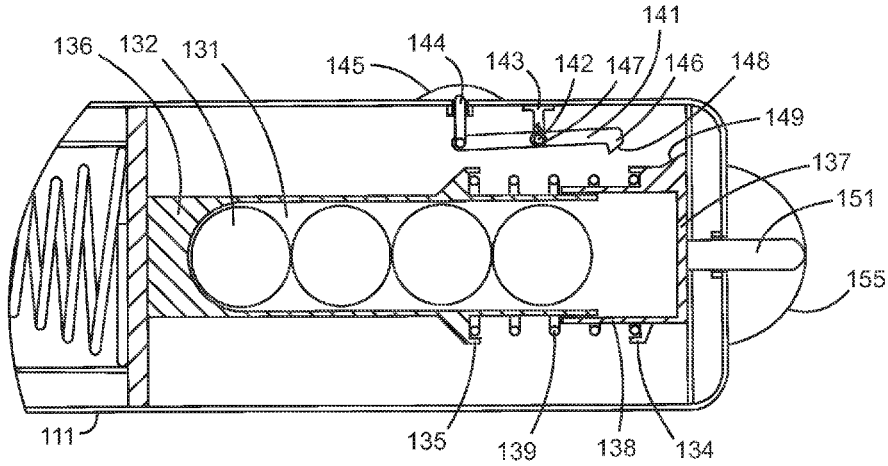
FIG. 3B shows the clacker of FIG. 3A in an on-position.
Figure 4A:
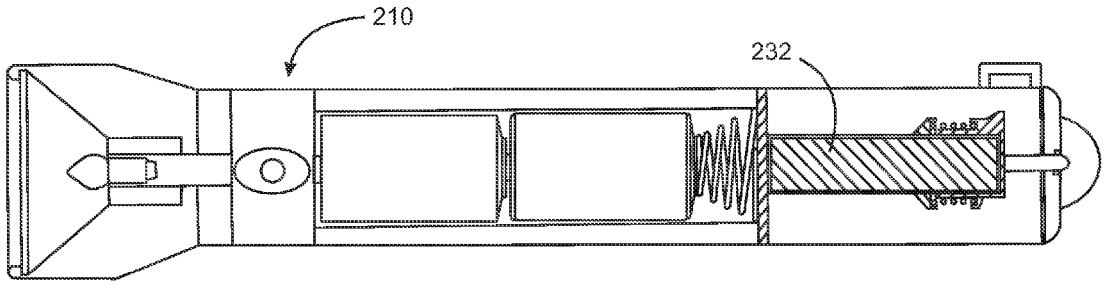
FIG. 4A is a schematic cross-sectional top view of a third embodiment of dive accessory, with a clacker in an "off"-position.
Figure 4B:
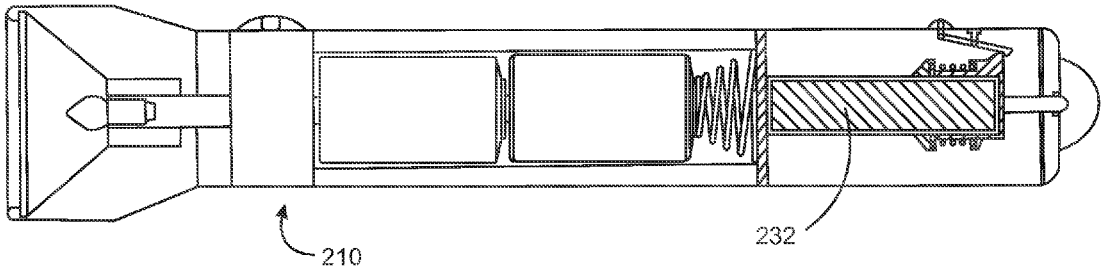
FIG. 4B is a schematic cross-sectional side view of the FIG. 4A dive accessory.
Figure 5A:
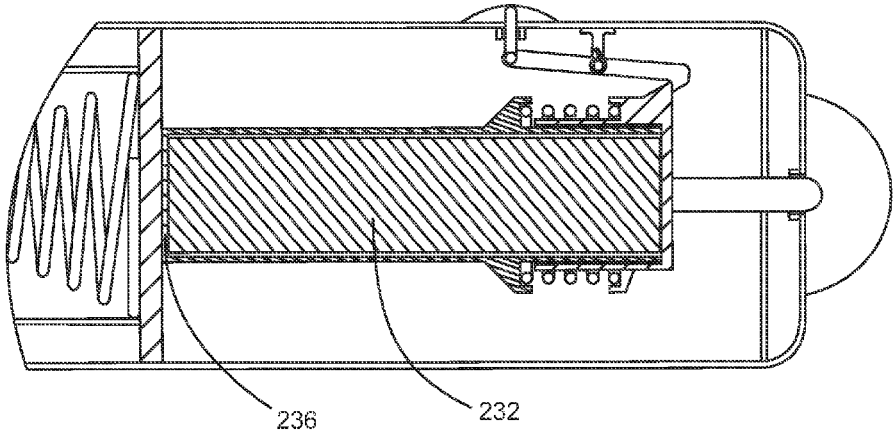
FIG. 5A is an enlarged view of the clacker depicted in FIG. 4A.
Figure 5B:
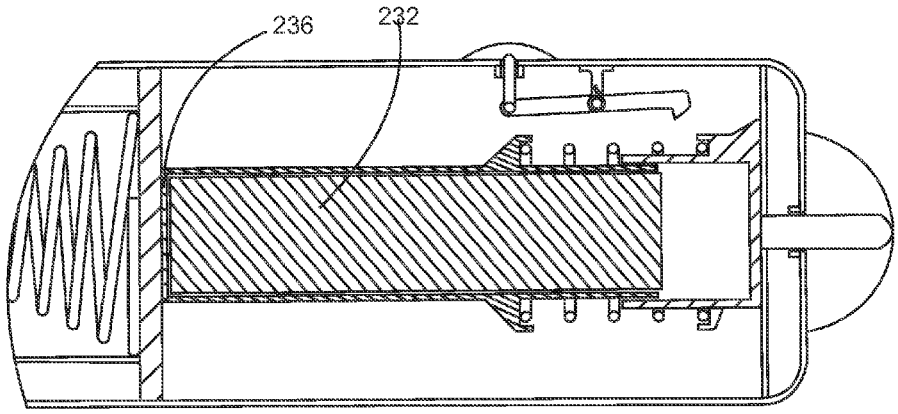
FIG. 5B shows the clacker of FIG. 5A in an "on"-position.

Referring to FIGS. 2A, 2B, 3A and 3B, a second embodiment of a dive accessory 110 of the present invention is depicted. FIGS. 2A and 2B show a clacker in an off-position. FIG. 3A is an enlarged view of the clacker depicted in FIGS. 2A and 2B, and FIG. 3B shows the clacker of FIG. 3A in an on-position. Dive accessory 110 comprises a shock resistant plastic outer shell 111 completely enclosing internal components. A D-ring 115 on the outer shell 111 may be used as an attachment point for a tether line (not shown) or other dive utility items.

Transparent front lens 112 permits illumination in front of the dive accessory from a light maker comprising LED 121 electrically connected to two D-cell batteries 122,123. LED 121 and batteries 122,123 are located in compartments 124, 125, respectively. LED 121 is switched on and off using a depression switch 113 located under elastomeric membrane seal 114. The mechanical and electrical arrangement for the light maker is typical of the art, for example as described in U.S. Pat. Nos. 6,547,414, 4,114,187, 4,531,178 or 4,870,550, the disclosures of which are herein incorporated by reference.

The clacker comprises a cylindrical hollow chamber 131 containing four spherical solid stainless steel ball bearings 132 (only one labeled). The hollow chamber 131 comprises a fixed end wall 136 and a movable end wall 137. The movable end wall 137 is part of a thimble 138 that fits over and caps one end of the hollow chamber 131. As seen in comparing FIG. 3A to FIG. 3B, the movable end wall 137 is movable between a retracted position (FIG. 3A) and an extended position (FIG. 3B). When movable end wall 137 is in the retracted position (i.e. the off-position) the bearings 132 are restrained between the two end walls 136,137 so that the bearings are unable to move and unable to create noise. When movable end wall 137 is in the extended position (i.e. the on-position) the bearings 132 are permitted to move between the two end walls 136,137 so that, in response to the dive accessory being shaken, the bearings are able strike the end walls to create noise. A compression spring 139 biases the movable end wall 137 toward the extended position. The compression spring 139 is seated between lips 134,135 on the thimble 138 and the exterior of the hollow chamber 131, respectively.

Still referring to FIGS. 2A, 2B, 3A and 3B, it can be seen that means for selectively restraining movement of the bearings and means for selectively permitting movement of the bearings are different means having the movable end wall 137 as a common element.

The means for selectively permitting movement of the bearings comprises a depression switch having an armature 141 pivotally attached at a pivot point 142 to a pivot support 143. The pivot support 143 is attached to the inside of the outer shell 111. One end of the armature 141 is pivotally connected to an activation pin 144 under an elastomeric membrane seal 145. Another end of the armature 141 comprises a latch 146 that catches and holds the movable end wall 137 in the retracted position (FIG. 3A). Depression of the activation pin 144 causes the armature 141 to pivot at the pivot point 142 thereby lifting the latch 146 thereby disengaging the latch from the movable end wall. The movable end wall 137 is then free to move to the extended position (FIG. 3B), which it does automatically under the biasing influence of the compression spring 139. A torsion spring 147 located around the pivot point 142 automatically biases the latch 146 back into position for engaging the movable end when pressure is removed from the activation pin 144. The latch and the end wall have angled surfaces 148,149 respectively that permit the latch to snap back into engagement with the movable end wall 137 as the movable end wall is returned to the retracted position.

The means for selectively restraining movement of the bearings comprises a piston 151 attached to the movable end wall 137. Depression of the piston 151 when the movable end wall 137 is in the extended position (FIG. 3B) causes the movable end wall to move against the biasing effort of the compression spring 139 until the latch 146 engages the movable end wall in the retracted position holding the movable end wall in place (FIG. 3A). The piston 151 is located under an elastomeric membrane seal 155. A diver may apply sufficient pressure to the piston 151 to return the clacker to the off-position by applying the piston against an object, for example a rock, the diver's leg, the diver's palm, etc.

Referring to FIGS. 4A, 4B, 5A and 5B, a third embodiment of a dive accessory 210 of the present invention is depicted. The dive accessory 210 is similar to the dive accessory 110 previously described. However, dive accessory 210 comprises a single solid stainless steel cylinder 232 instead of four spherical solid stainless steel ball bearings. Since a cylinder is being used instead of spheres, fixed end wall 236 is flat instead of concave. Otherwise, the embodiment depicted in FIGS. 4A, 4B, 5A and 5B is constructed and works the same as the embodiment of FIGS. 2A, 2B, 3A and 3B.

Figure 6A:
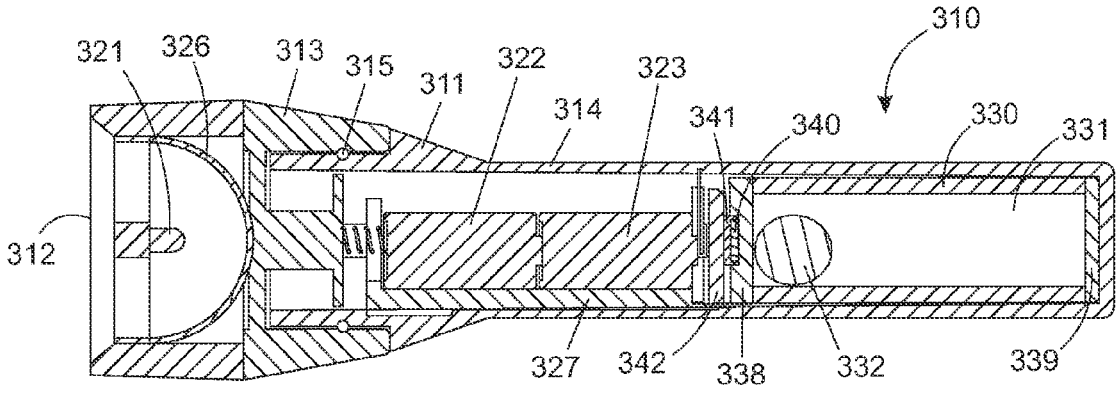
FIG. 6A is a schematic cross-sectional side view of a fourth embodiment of a dive accessory, with a clacker in an "off" position; and, FIG. 6B is an exploded view of the dive accessory of FIG. 6A.
Figure 6B:
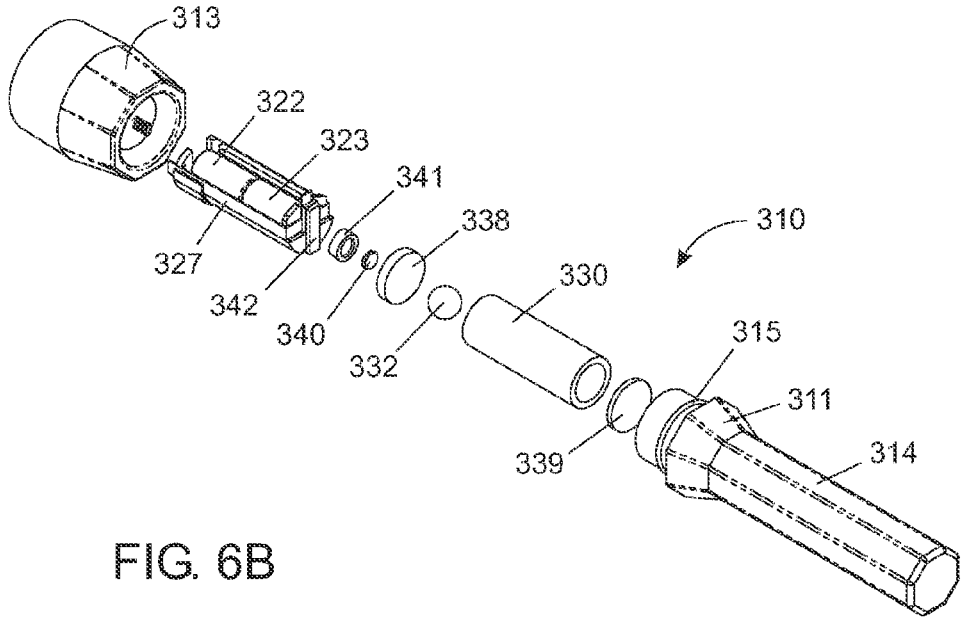

Referring to FIGS. 6A and 6B, a fourth embodiment of a dive accessory 310 is depicted in which an existing dive light is retrofitted with a modular clacker. Dive accessory 310 comprises an existing dive light having shock resistant waterproof outer shell 311 in which transparent front lens 312 permits illumination in front of the dive accessory from a light maker comprising parabolic mirror 326 and LED 321. LED 321 is electrically connected to two lithium CR 123 batteries 322,323, which are supported in battery holder 327 replacing three C-cells that are normally in the dive light. Use of the lithium batteries rather than C-cells provides extra space at the end of outer shell 311. LED 321 is switched on and off by rotating head 313 of the dive light clockwise and counterclockwise. O-ring 315 seals the joint between head 313 and body 314 of outer shell 311.

The modular clacker fits within outer shell 311 and occupies the extra space provided by the use of the lithium batteries rather than the C-cells. The modular clacker comprises cylindrical housing 330 having fixedly attached end walls 338,339 enclosing hollow chamber 331. Embedded in and glued to end wall 338 is magnet 340, which is surrounded on three sides by magnetic shielding 341 glued on to end wall 338 over magnet 340. Shown within hollow chamber 331 is steel bearing 332 located in a hold position at end wall 338 where it is held in place by magnet 340. Magnet 340 is sufficiently strong to hold bearing 332 in place under normal circumstances. When dive accessory 310 is shaken vigorously, magnet 340 is unable to hold bearing 332 and bearing 332 is free to move from end to end in the hollow chamber making noise when it strikes the ends. Foam piece 342 isolates the impact of bearing 332 from the light maker to prevent damage to the light maker.

Magnet 340 is a neodynium disc magnet from Gaussboys Super Magnets having a size 0.0787 inches thick by 0.354 inches in diameter, a volume of 0.008 cubic inches and an end having an area of 0.098 square inches. The magnet has a strength rating of N45, a flux density of 13.5 KGs and a magnetic strength at the surface of 2900 gauss. Steel bearing 332 is 0.625 inches in diameter weighing 0.036 pounds having a volume of 0.128 cubic inches. Steel bearing 332 is spaced 0.125 inches away from magnet 340 when the bearing is in the hold position. In such an arrangement, the field strength of the magnet is sufficient to hold the solid object at the hold position when the dive accessory is not being shaken and insufficient to hold the solid object when the dive accessory is being shaken.

Steel bearing 332 may be replaced by a steel slug. When a slug is used, the following arrangement provides a magnet with a field strength sufficient to hold the solid object at the hold position when the dive accessory is not being shaken and insufficient to hold the solid object when the dive accessory is being shaken. The magnet is a neodynium disc magnet from Gaussboys Super Magnets having a size 0.118 inches thick by 0.472 inches in diameter with a volume of 0.021 cubic inches and an end having an area of 0.177 square inches. The magnet has a strength rating of N35, a flux density of 11.9 KGs and a magnetic strength at the surface of 3000 gauss. The steel slug is 0.625 inches in diameter by 1.25 inches long filleted on the ends and has a weight of 0.101 pounds and a volume of 0.36 cubic inches. The distance from the steel slug to the magnet is 0.180 inches.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A dive accessory comprising:

an outer shell encompassing a light maker and a noise maker;

the light maker being waterproofed and comprising a light source electrically connected to an electrical power source for powering the light source, and a light switch for selectively opening and closing the electrical connection between the light source and the electrical power source to switch the light source between an on state and an off state, and the noise maker comprising a hollow chamber having a solid object therein, the solid object movable within the hollow chamber to produce a noise when the solid object strikes a wall of the hollow chamber, the noise maker further comprising a rotary switch having a screw element for moving a side wall of the hollow chamber, providing means for selectively permitting and restraining movement of the solid object.

2. The dive accessory of claim 1, wherein:

the outer shell is waterproofed and the hollow chamber is entirely encompassed within the outer shell.

3. A dive accessory comprising:

an outer shell encompassing a light maker and a noise maker;

the light maker being waterproofed and comprising:

a light source;

an electrical power source, electrically connected to the light source for powering the light source, and a light switch for selectively opening and closing the electrical connection between the light source and the electrical power source to switch the light source between an "on " state and an "off " state, and the noise maker comprising:

a hollow chamber;

a solid object positioned and movable within the hollow chamber to produce a noise when the solid object strikes a wall of the hollow chamber;

means for selectively permitting movement of the solid object; and means for selectively restraining movement of the solid object to prevent the solid object from making noise;

wherein the selective restraining means and the selective movement means share a moveable wall within the hollow chamber as a common element.

4. A dive accessory comprising:

an outer shell encompassing a light maker and a noise maker;

the light maker being waterproofed and comprising:

a light source;

an electrical power source, electrically connected to the light source for powering the light source, and a light switch for selectively opening and closing the electrical connection between the light source and the electrical power source to switch the light source between an "on " state and an "off " state, and the noise maker comprising:

a hollow chamber;

a solid object positioned and movable within the hollow chamber to produce a noise when the solid object strikes a wall of the hollow chamber; and a variable field strength electromagnet for selectively restraining movement of the solid object in the hollow chamber.

5. A dive accessory comprising:

an outer shell encompassing a light maker and a noise maker;

the light maker being waterproofed and comprising:

a light source;

an electrical power source, electrically connected to the light source for powering the light source, and a light switch for selectively opening and closing the electrical connection between the light source and the electrical power source to switch the light source between an "on " state and an "off " state, and the noise maker comprising:

a hollow chamber;

a solid object positioned and movable within the hollow chamber to produce a noise when the solid object strikes a wall of the hollow chamber; and a slide switch, slidably movable within the hollow chamber between a restraining position and a liberating position.

6. The dive accessory of claim 5, wherein:

the slide switch further comprises means for automatically returning the switch to the restraining position.

7. The dive accessory of claim 6, wherein the automatic return means comprises a spring.

8. A dive accessory comprising:

an outer shell encompassing a light maker and a noise maker;

the light maker being waterproofed and comprising:

a light source;

an electrical power source, electrically connected to the light source for powering the light source, and a light switch for selectively opening and closing the electrical connection between the light source and the electrical power source to switch the light source between an "on " state and an "off " state, and the noise maker comprising:

a hollow chamber;

a solid object positioned and movable within the hollow chamber to produce a noise when the solid object strikes a wall of the hollow chamber;

means for selectively permitting movement of the solid object; and means for selectively restraining movement of the solid object to prevent the solid object from making noise;

wherein the selective restraining means and the selective movement means are different means that share a common element.

9. A dive accessory comprising:

an outer shell encompassing a light maker and a noise maker;

the light maker being waterproofed and comprising:

a light source;

an electrical power source, electrically connected to the light source for powering the light source, and a light switch for selectively opening and closing the electrical connection between the light source and the electrical power source to switch the light source between an "on " state and an "off " state, and the noise maker comprising:

a hollow chamber;

a solid object positioned and movable within the hollow chamber to produce a noise when the solid object strikes a wall of the hollow chamber; and means for selectively restraining movement of the solid object that permits movement of the solid object to make noise upon shaking of the dive accessory.

10. The dive accessory of claim 8, wherein:

the hollow chamber comprises a movable end that is movable between a retracted position for restraining movement of the solid object and an extended position for permitting movement of the solid object.

11. The dive accessory of claim 10, wherein:

the movable end, when in the retracted position, engages the selective movement means in order to allow the movable end to move to the extended position only when the selective movement means is activated.

12. The dive accessory of claim 11, wherein:

the selective movement means comprises an armature having means for engaging and holding the movable end in the retracted position and means for disengaging and permitting the movable end to move to the extended position.

13. The dive accessory of claim 12, wherein:

the selective movement means further comprises means for biasing the armature into a position for engaging the movable end.

14. The dive accessory of claim 13, wherein:

the armature comprises a first and a second portion, with a pivot point therebetween, the means for engaging and holding the movable end located on the first portion, the means for disengaging and permitting movement of the movable end located on the second portion, and the biasing means comprises a torsion spring at the pivot point, such that activating the disengaging means causes the armature to pivot at the pivot point thereby disengaging the armature from the movable end, and deactivating the disengaging means permits the torsion spring to bias the armature into the position for engaging the movable end.

15. The dive accessory of claim 14, wherein:

the selective restraint means comprises a piston connected to the movable end, such that depressing the piston causes the movable end to move to the retracted position, restraining movement of the solid object.

16. The dive accessory of claim 15, further comprising:

a means for biasing the movable end toward the extended position.

17. The dive accessory of claim 16, wherein:

the biasing means for biasing the movable end toward the extended position comprises a compression spring exterior to the hollow chamber.

18. The dive accessory of claim 9, wherein:

the means for restraining movement comprises a magnet and the solid object comprises a ferromagnetic material.

19. The dive accessory of claim 18, wherein:

the magnet is a permanent magnet.

20. The dive accessory of claim 18, wherein:

the magnet is located on the hollow chamber at a hold position and the magnet has a field strength sufficient to hold the solid object proximate to the hold position when the dive accessory is not being shaken and insufficient to hold the solid object when the dive accessory is being shaken.

21. The dive accessory of claim 18, wherein:

the noise maker comprises a module inserted in the outer shell, the module comprising a housing sized to fit in the outer shell, the housing enclosing the hollow chamber, and the magnet is attached to the housing at a hold position, the magnet having a field strength sufficient to hold the solid object proximate to the hold position when the dive accessory is not being shaken and insufficient to hold the solid object when the dive accessory is being shaken.

22. The dive accessory of claim 21, wherein:

the magnet is immovably integrated into the housing.

23. The dive accessory of claim 18, wherein:

the magnet is located at an end of the hollow chamber.

* * * * *